United States Patent [19]

Guillin

[11] Patent Number: 4,753,351

[45] Date of Patent: Jun. 28, 1988

[54] CONTAINER FOR PACKAGING

[76] Inventor: Francois Guillin, 25920 Mouthier-Haute-Pierre, France

[21] Appl. No.: 848,644

[22] Filed: Apr. 7, 1986

[30] Foreign Application Priority Data

Sep. 24, 1985 [FR] France ..... 85 14235

[51] Int. Cl.[4] ..... B65D 21/04; B65D 43/16; B65D 43/10

[52] U.S. Cl. ..... 206/520; 206/518; 220/82 R; 220/72; 220/307; 220/339; 229/2.5 R; 229/160.2

[58] Field of Search ..... 206/518, 515, 520; 220/82 R, 339, 307, 72; 229/2.5 R, 44

[56] References Cited

U.S. PATENT DOCUMENTS

| | | | |
|---|---|---|---|
| 2,867,353 | 1/1959 | Botham | 220/82 R |
| 3,017,987 | 1/1962 | Moslo | 220/82 R |
| 3,082,903 | 3/1963 | Stevens | 220/339 |
| 3,095,133 | 6/1963 | Vogt | 229/2.5 R |
| 3,253,762 | 5/1966 | Gaunt | 229/2.5 R |
| 3,385,422 | 5/1968 | Lowry | 229/44 |
| 3,443,720 | 5/1969 | Al-Roy | 220/307 |
| 3,551,940 | 1/1971 | Edison | 220/339 |
| 3,654,076 | 4/1972 | Hatch | 206/520 |
| 3,710,975 | 1/1973 | Jansen | 220/339 |
| 3,968,921 | 7/1976 | Jewell | 220/307 |
| 4,243,140 | 1/1981 | Thrum | 229/2.5 R |
| 4,244,470 | 1/1981 | Burnham | 229/2.5 A |
| 4,494,650 | 1/1985 | Cullen | 229/2.5 R |

FOREIGN PATENT DOCUMENTS

| | | | |
|---|---|---|---|
| 2223253 | 10/1974 | France | 220/339 |

*Primary Examiner*—George E. Lowrance

*Attorney, Agent, or Firm*—Frishauf, Holtz, Goodman & Woodward

[57] ABSTRACT

Container for packaging hot or cold foods or other goods and produced by thermoforming sheets of plastic such as P.V.C., polystyrene or other similar plastics. This container is characterized by its prismatic shape with polygonal base, which on stacking hold the container firm and rigid both when empty and when filled with either hot or cold foods.

2 Claims, 2 Drawing Sheets

CONTAINER FOR PACKAGING

This invention concerns a container for presenting and protecting consumable goods destined for the consumer himself or the end user.

The container is in the form of a box with a cover, polygonal in shape and produced by thermoforming a plastic sheet in P.V.C., polystyrene or other similar non-limiting material.

Whether full or empty, the container is easily stacked and when empty can be stored by stacking one box inside the other without jamming.

At present, a large number of containers are manufactured and adapted to the demands of the distributors which has led to a great variety of boxes in all kinds of forms which neglect conditions of fundamental importance such as rigidity and sealing of the cover during handling and transport. These defects become even more important when the containers are used for packaging hot foods. The heat alters the mechanical characteristics of the plastic used and consequently those of the container, especially if it has been badly designed or designed, as is often the case, from a purely esthetic point of view.

This invention aims at replacing all types of plastic packaging for prepared foods or other goods, whether hot or cold. It corresponds to those conditions of utilization, among others, which concern rigidity, the sealing of the container with an attached and fastened cover, heat insulation, ease of storage by stacking whether empty or full, and transparency enabling or not the contents to be visible.

The invention will be better understood after reading the following description and by refering to the appended drawings.

FIG. 1*a* is a general view of the container.

FIG. 1*b* shows the notches on the base.

Figure 1A:
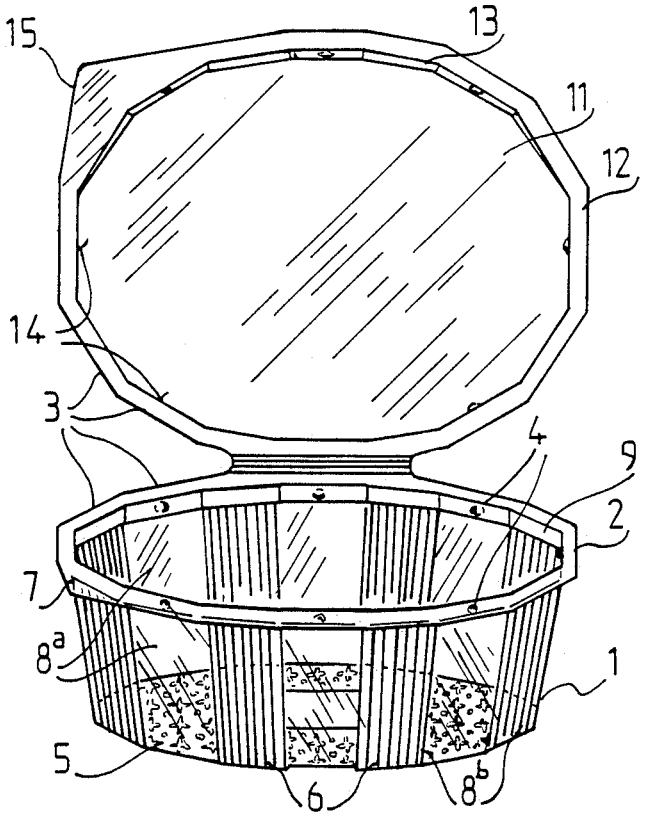

With reference to FIG. 1*a*, the food product packaging according to this invention is characterized in that the receptacle (1) is prismatic in shape with a polygonal base 5. It has sixteen sides (3) or sidewalls defining an oblong outer contour, although this is non-limiting, forming a succession (8*a*–8*b*) of alternating smooth (8*a*) and grooved (6-8*b*) facets side walls providing both transparency and enhanced rigidity. The grooves extend away from and transversely to the base 5. The contents of the container are visible through the smooth transparent facets (8*a*). The side walls extend away from and transversely from the base 5.

Figure 1B:
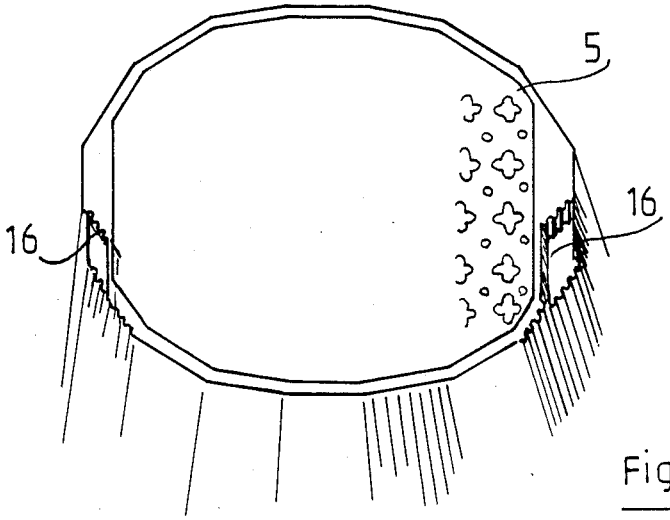

The base shown in FIG. 1b provides the sixteen-sided polygonal shape (3) and is characterized in that the plastic sheet is embossed with a concave/convex decoration. This is aimed at considerably reducing the internal contact surfaces thus reducing adherence of the food. The relief decoration, like the grooved external surfaces, also lends rigidity to the base. The base comprises two notches (16) arranged symmetrically which prevent two containers from jamming with one another when stored empty.

The receptacle (1) is opened by a system characterized in that a lip or rim portion (9) forming part of a flat piece (2) forms a hinge (10) which in turn forms part of a cover (11) and a closing system. These all contribute to the sealing of the container and will now each be described separately. Rim portions (9) extend from the side walls at ends of the side walls facing away from the base (5) and substantially in parallel with the base (5).

The flat piece (2) widens out in one corner of the polygon to form a tab (7) facilitating opening of the cover (11).

Figure 2:
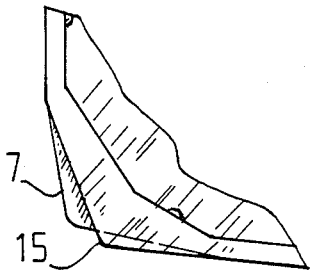
FIG. 2 shows the system facilitating opening of the cover when the container is closed.

The cover (11) is characterized in that it is also in the form of a sixteen-sided polygon (3) fitted with a circumferentially extending lip (13) forming part of a flat piece (12). One corner of this piece (12) is widened to form a tab (15) which facilitates opening of the container by its non-alignment with tab (7) (see FIG. 2). The cover can be opened by pulling the two tabs apart.

The size of lip (13) has been chosen so that it coincides perfectly with the inside of lip or rim portion (9) on receptable (1), thus sealing the box when closed by bringing the cover and base together. Its concave form contributes to the stacking of full containers without any fear of slipping.

Unlike base (5) and the facets (8*b*) of receptacle (1), the cover is completely smooth and transparent allowing the entire contents to be visible.

Figure 3:
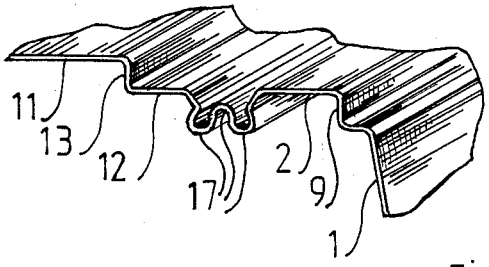
FIG. 3 shows the hinge system when open.
Figure 4:
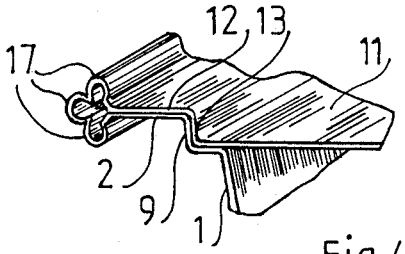
FIG. 4 shows the hinge system when closed.

The flat piece (12) forms part of hinge (10), characterized in that it is formed by three wave-shaped folds (17) which on deformation allow the cover to swing backwards and forwards on opening and closing the container. FIGS. 3 and 4 show the open and closed positions.

These three wave-shaped folds (17) making up the hinge are in an off-set position with respect to lip (9) and this allows a perfect fit of lip (13) on cover (11) with lip (9) on the receptacle. The flat pieces (12 and 13) come together to form an extremely efficient seal aided in particular by the shape of the container.

To avoid unintentional opening, the container comprises an incorporated cover locking system characterized in that locking is obtained by the fitting together of two parts, one convex and the other concave.

FIG. 1*a* shows lip or rim portion (9) with its relief pattern (4) in the form of inwardly extending projections (18) and lip (13) of cover (11) with its concave pattern (14). These patterns correspond with each other and form a regular arrangement at the edges of the lips. The projections (18) are only formed on rim portions (9) juxtaposed with respective sidewalls which are free of any grooves.

Figure 5:
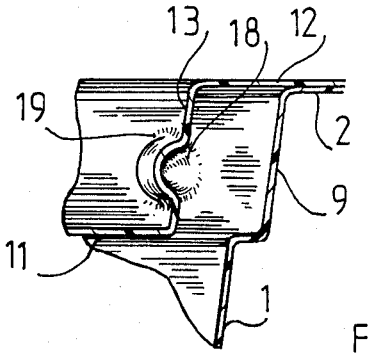
FIG. 5 shows the cover locking system.

Referring to FIG. 5, which shows the closed and locked cover, the lip (9) on receptacle (1) can be seen with its convex form or projections (18). This thermoformed dome-shape fits into or made with a corresponding thermoformed hollow or recess (19) of the same geometric shape in the closed state of the receptacle or container.

On closing the cover (11), a slight pressure on lip (13) fits it into lip (9) on receptacle (1). When lip (13) meets the dome-shape (18), a small increase in pressure slightly deforms the dome as the plastic of which the container is made has a certain elasticity. The dome fits into hollow (19) and regains its original shape, whilst the flat pieces (2) and (12) are brought together to give a perfect fit.

To open the container, the cover (11) has to be slightly "torn" away by pulling tabs (7 and 15) apart and gradually separating the convex forms (4 and 18) from their corresponding hollows (14 and 19). The container can therefore be seen to be formed with releasable locking means.

As the dome-shaped lock is by no means limiting, any other shape can be used providing that the convex and concave forms can overlap without permanently deforming lips (9) and (13).

Under certain conditions of use, the container with its base and hinged cover is characterized in that it can be manufactured with the cover detached. The fastening system remains the same and its qualities are in no way altered as compared to those described above.

I claim:

1. A container adapted for packaging both hot or cold foods or other goods, and manufactured by thermoforming sheets of plastic from P.V.C. or polystyrene, comprising in combination a polygonally-shaped base, a plurality of sidewalls extending away from, and transversely to said base, said sidewalls defining an outer oblong contour, a circumferentially extending polygonal rim, and having a plurality of rim portions extending from said sidewalls at ends thereof facing away from said base, and substantially in parallel with said base, a polygonal cover hingeably attached to said polygonal rim and formed with a circumferentially extending polygonal lip, releasable locking means matingly connecting the lip of said cover to said polygonal rim in a closed state of said container, said releasable locking means including a plurality of projections formed on respective of said rim portions, and a plurality of recesses formed in said lip and mating with said projections in the closed state of said container, a hinge connecting said polygonal cover to said polygonal rim, said hinge being formed by wave-shaped deformable folds, whereby said deformable folds allow said cover to close so as to seal perfectly with said sidewalls, wherein alternate of said sidewalls are faceted and formed with grooves to enhance rigidity of said sidewalls, especially in a direction extending away from and transversely to said base, the remaining of said sidewalls being free of any grooves, said projections being only formed on rim portions juxtaposed with respective of said sidewalls which are free of any grooves, wherein the polygonally-shaped base is formed with two notches that are arranged symmetrically on said base so as to prevent two containers from jamming with one another when stored empty, wherein the groove-free sidewalls are smooth and transparent, thereby allowing the container contents to be visible wherein the circumferentially extending lip of said cover is formed with a first outwardly projecting tab, and said rim is formed with a second outwardly projecting tab, whereby said lip is torn away from said rim by pulling said tabs in respective opposite directions whereby said container can be opened by tearing said lip away from said rim, and whereby another container can be stacked on top of said container.

2. A prismatically shaped container adapted for packaging both hot or cold foods or other goods, and manufactured by thermoforming sheets of plastic from P.V.C. or polystyrene, comprising in combination a hollow receptacle having the shape of a truncated pyramid, formed with a polygonal rim, and having a polygonal base opposite said rim, a polygonal concave cover formed with a plurality of sides, a hinge articulatably attached to said receptacle and to said cover along one of said sides, and made in one piece therewith, said hinge being formed by deformable wave-shaped folds, whereby said cover can close and seal said receptacle perfectly, and whereby another container can be stacked on top of said cover, said receptacle having alternating grooved sidewalls to enhance rigidity of said sidewalls, and transparent sidewalls free of any grooves, said sidewalls defining an outer oblong contour, said receptacle being formed with a plurality of inwardly extending dome-shaped projections located on portions of said rim juxtaposed with corresponding of said transparent sidewalls, said cover being formed with convex recesses arranged to fittingly receive respective of said projections, said projections being only formed on rim portions juxtaposed with respective of said sidewalls which are free of any grooves, said base being formed with symmetrically disposed notches as seen from the outside along the bottom thereof and appearing as embossements as seen from the inside of said receptacle, so as to prevent two containers from jamming together when placed one inside the other for storage, said cover and said receptacle on a side juxtaposed with said cover being formed with horizontally extending tabs facilitating opening of the container when closed.

* * * * *